US008794803B1

(12) United States Patent
Paulsel

(10) Patent No.: US 8,794,803 B1
(45) **Date of Patent: *Aug. 5, 2014**

(54) ADJUSTABLE LED MODULE WITH STATIONARY HEAT SINK

(71) Applicant: Jason Q. Paulsel, Peachtree City, GA (US)

(72) Inventor: Jason Q. Paulsel, Peachtree City, GA (US)

(73) Assignee: Cooper Technologies Company, Houston, TX (US)

( * ) Notice: Subject to any disclaimer, the term of this patent is extended or adjusted under 35 U.S.C. 154(b) by 14 days.

This patent is subject to a terminal disclaimer.

(21) Appl. No.: 13/849,140

(22) Filed: Mar. 22, 2013

Related U.S. Application Data

(63) Continuation of application No. 13/015,877, filed on Jan. 28, 2011, now Pat. No. 8,403,533.

(51) Int. Cl.
*F21V 15/00* (2006.01)

(52) U.S. Cl.
USPC ..... 362/365; 362/249.02; 362/249.03; 362/364; 362/366

(58) Field of Classification Search
USPC ..... 362/147, 148, 237–240, 243, 244, 362/249.02, 249.1, 276, 277, 282, 294, 304, 362/311.01, 311.02, 311.14, 319, 345, 347, 362/350, 364–366, 371–373, 427, 800, 362/249.01
See application file for complete search history.

(56) References Cited

U.S. PATENT DOCUMENTS

| | | | | |
|---|---|---|---|---|
| 5,951,151 | A * | 9/1999 | Doubeck et al. | 362/365 |
| 6,375,338 | B1 | 4/2002 | Cummings et al. | |
| 6,464,506 | B1 | 10/2002 | Welles | |
| 6,719,438 | B2 * | 4/2004 | Sevack et al. | 362/147 |
| 7,297,083 | B2 | 11/2007 | Duncan | |
| 7,744,259 | B2 | 6/2010 | Walczak et al. | |
| 8,152,334 | B2 | 4/2012 | Krogman | |
| 8,172,436 | B2 | 5/2012 | Coleman et al. | |
| 2010/0315812 | A1 | 12/2010 | Liu | |
| 2011/0164422 | A1 | 7/2011 | Chan | |
| 2012/0163005 | A1 | 6/2012 | Liu | |

* cited by examiner

*Primary Examiner* — Hargobind S Sawhney
(74) *Attorney, Agent, or Firm* — King & Spalding LLP

(57) ABSTRACT

A luminaire includes a stationary heat sink and an LED module adjustably coupled to the stationary heat sink. The LED module is inserted into a cavity formed within the stationary heat sink and includes a slot therein. The slot includes a first and second end. According to some exemplary embodiments, a fastening device is inserted through the slot and fixedly coupled to an interior sidewall of the stationary heat sink. The LED module is directionally adjustable by sliding the slot between the ends with respect to the fixedly coupled fastening device. The LED module includes a second heat sink which is rotatable with respect to the stationary heat sink and maintains continuous contact with the stationary heat sink along the LED module's full rotational range. According to some exemplary embodiments, the first end is positioned lower than the second end. According to some exemplary embodiments, the slot is arcuately-shaped.

20 Claims, 8 Drawing Sheets

ADJUSTABLE LED MODULE WITH STATIONARY HEAT SINK

CROSS REFERENCE TO RELATED APPLICATIONS

This patent application is a continuation of and claims priority under 35 U.S.C. §120 to U.S. patent application Ser. No. 13/015,877 titled "Adjustable LED Module With Stationary Heat Sink" filed on Jan. 28, 2011, the entire content of which is hereby incorporated by reference herein.

FIELD OF THE INVENTION

The present invention relates generally to luminaires. More specifically, the invention relates to a luminaire having a light emitting diode ("LED") module that is adjustably coupled to a stationary heat sink.

BACKGROUND

LEDs offer benefits over incandescent and fluorescent lights as sources of illumination. Such benefits include high energy efficiency and longevity. To produce a given output of light, LEDs consume less energy than incandescent or fluorescent lights. Additionally, on average, LEDs last longer than incandescent or fluorescent lights before failing.

The level of light a typical LED outputs depends upon the amount of electrical current supplied to the LED and upon the operating temperature of the LED. That is, the intensity of light emitted by the LED changes according to electrical current and LED temperature. Operating temperature also impacts the usable lifetime of LEDs.

As a byproduct of converting electricity into light, LEDs generate heat and raise the operating temperature, resulting in efficiency degradation and premature failure. Typically, a heat management system, such as a heat sink, is used in conjunction with the LEDs to facilitate maintenance of proper LED operating temperatures. Conventional LED-based downlight luminaires include a housing, a heat sink, and one or more LEDs. The housing includes a cavity formed therein and an opening at one end. The housing is installed to or within a support structure, such as a ceiling, and oriented such that the opening faces a desired illumination area. The opening can be positioned in substantially the same plane as a surface of the support structure or alternatively in a different plane than the surface of the support structure. The heat sink for LED-based downlights is typically large to effectively remove heat away from the LEDs. The heat sink is installed and fitted within the cavity of the housing and substantially occupies the entirety of the available volume of the cavity to maximize its heat removal performance. Although heat sinks are constrained within the fixed volume of the housing when used in conjunction with an insulation contact (I.C.) rated housing, heat sinks can also be utilized within a non-fixed volume of the housing when used in conjunction with some types of non-insulation contact housings. The LEDs are typically coupled to a substrate, which is in thermal communication with the heat sink. The LEDs emit light and are oriented in a manner such that the light is directed to the desired illumination area through the opening. As a result of the heat sink occupying substantially all of the available volume of the cavity and the LEDs being thermally coupled to the heat sink, the LEDs are oriented in a fixed manner and are not directionally adjustable to provide flexibility in changing the desired illumination area.

According to one attempt that has been made to provide this flexibility, the heat sink has been made smaller to occupy less volume of the cavity, which thereby allows the heat sink and the LEDs coupled thereto to both translate in a particular direction. Since the heat sink is smaller, the performance of the smaller heat sink also is reduced. To accommodate for this reduced performance, fewer LEDs are coupled to the smaller heat sink and hence a lower light output is generated. Alternatively, the same number of LEDs are coupled to the smaller heat sink, but the performance and the longevity of the LEDs are adversely affected because the smaller heat sink is not large enough to effectively maintain the proper LED operating temperature. Additionally, the heat sink's range of movement is limited because although the heat sink has been made smaller, the heat sink is still relatively large and occupies a significant portion of the cavity's volume to remove the heat generated from the LEDs.

SUMMARY

One exemplary embodiment includes a luminaire. The luminaire can include a stationary heat sink and a rotatably adjustable LED module. The LED module can include an LED light source and a second heat sink. The second heat sink can be coupled to the LED light source and rotatably coupled to the stationary heat sink. At least a portion of the second heat sink can remain in contact with the stationary heat sink along the full range of rotation of the LED module.

Another exemplary embodiment includes a luminaire. The luminaire can include a stationary heat sink and a rotatably adjustable LED module. The stationary heat sink can include a top end, a bottom end, and a sidewall extending from the top end to the bottom end. The sidewall can surround a stationary heat sink cavity that extends from the bottom end towards the top end. The LED module can include one or more LED light sources and a second heat sink. The second heat sink can be thermally coupled to the LED light source and rotatably coupled to the stationary heat sink. At least a portion of the second heat sink can be inserted within the stationary heat sink cavity. At least a portion of the second heat sink can remain in contact with the stationary heat sink along the full range of rotation of the LED module.

Another exemplary embodiment includes a method for assembling a luminaire. The method can include providing a stationary heat sink that can include a sidewall surrounding a cavity formed therein. The method also can include inserting an LED module into the cavity. The LED module can include an LED light source and a second heat sink coupled to the LED light source. The method also can include rotatably coupling the LED module to the stationary heat sink. At least a portion of the second heat sink can remain in contact with the stationary heat sink along the full range of rotation of the LED module.

BRIEF DESCRIPTION OF THE DRAWINGS

For a more complete understanding of the present invention and the advantages thereof, reference is now made to the following description, in conjunction with the accompanying figures briefly described as follows.

Figure 1:
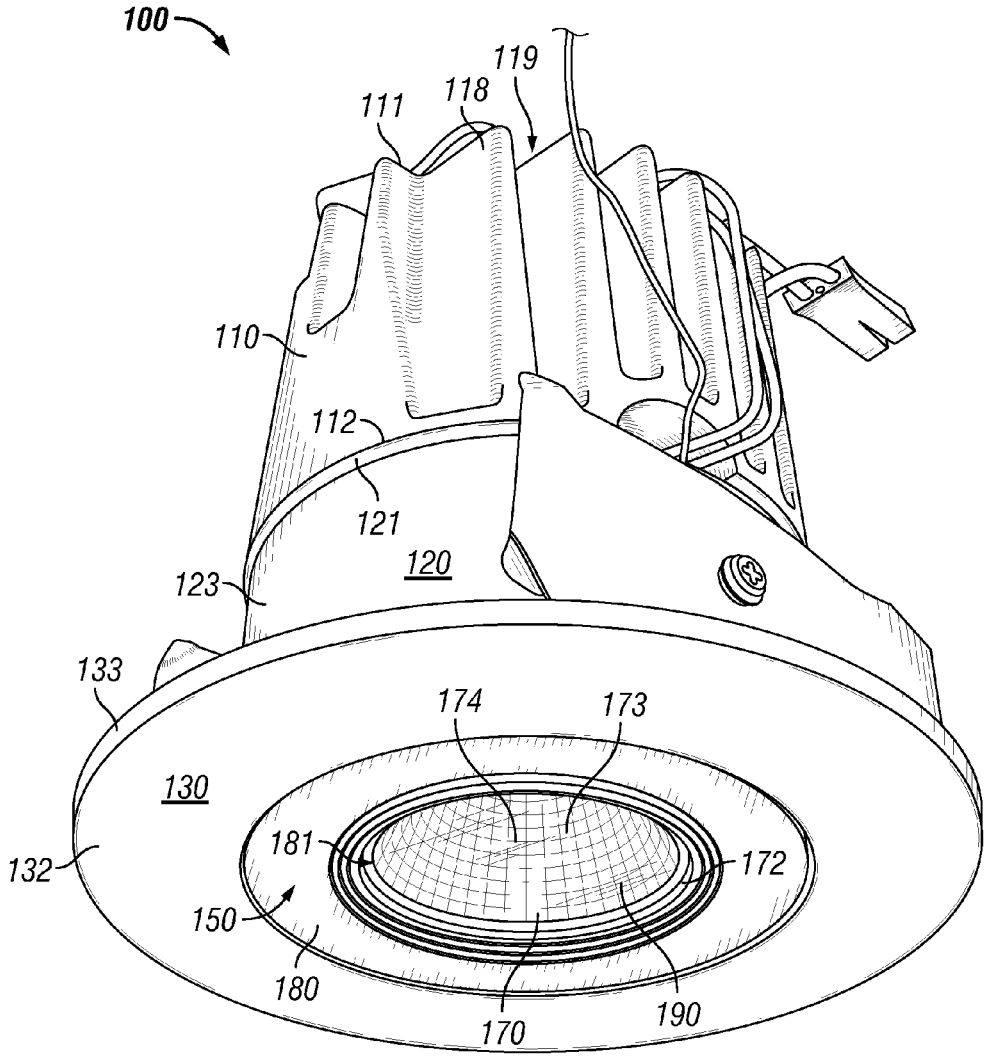
FIG. 1 is a perspective view of a luminaire according to an exemplary embodiment of the present invention.

The drawings illustrate only exemplary embodiments of the invention and are therefore not to be considered limiting of its scope, as the invention may admit to other equally effective embodiments.

DETAILED DESCRIPTION OF THE EXEMPLARY EMBODIMENTS

Embodiments of the present invention are directed to luminaires. In particular, the application is directed to a luminaire having a light emitting diode ("LED") module that is adjustably coupled to a stationary heat sink. The invention may be better understood by reading the following description of non-limiting, exemplary embodiments with reference to the attached drawings, wherein like parts of each of the figures are identified by like reference characters, and which are briefly described as follows.

The term "luminaire," as used herein, generally refers to a system for producing, controlling, and/or distributing light for illumination. For example, a luminaire includes a system that outputs or distributes light into an environment, thereby allowing certain items in that environment to be more visible. Such a system could be a complete lighting unit that includes one or more LEDs for converting electrical energy into light, sockets, connectors, or receptacles for mechanically mounting and/or electrically connecting components to the system, optical elements for distributing light, and mechanical components for supporting or attaching the luminaire. Luminaires are sometimes referred to as "lighting fixtures" or as "light fixtures." A lighting fixture that has a socket for a light source, but no light source installed in the socket, is still considered a luminaire. That is, a lighting system lacking some provision for full operability still fits the definition of a luminaire. Luminaires are used in indoor or outdoor applications.

Figure 2A:
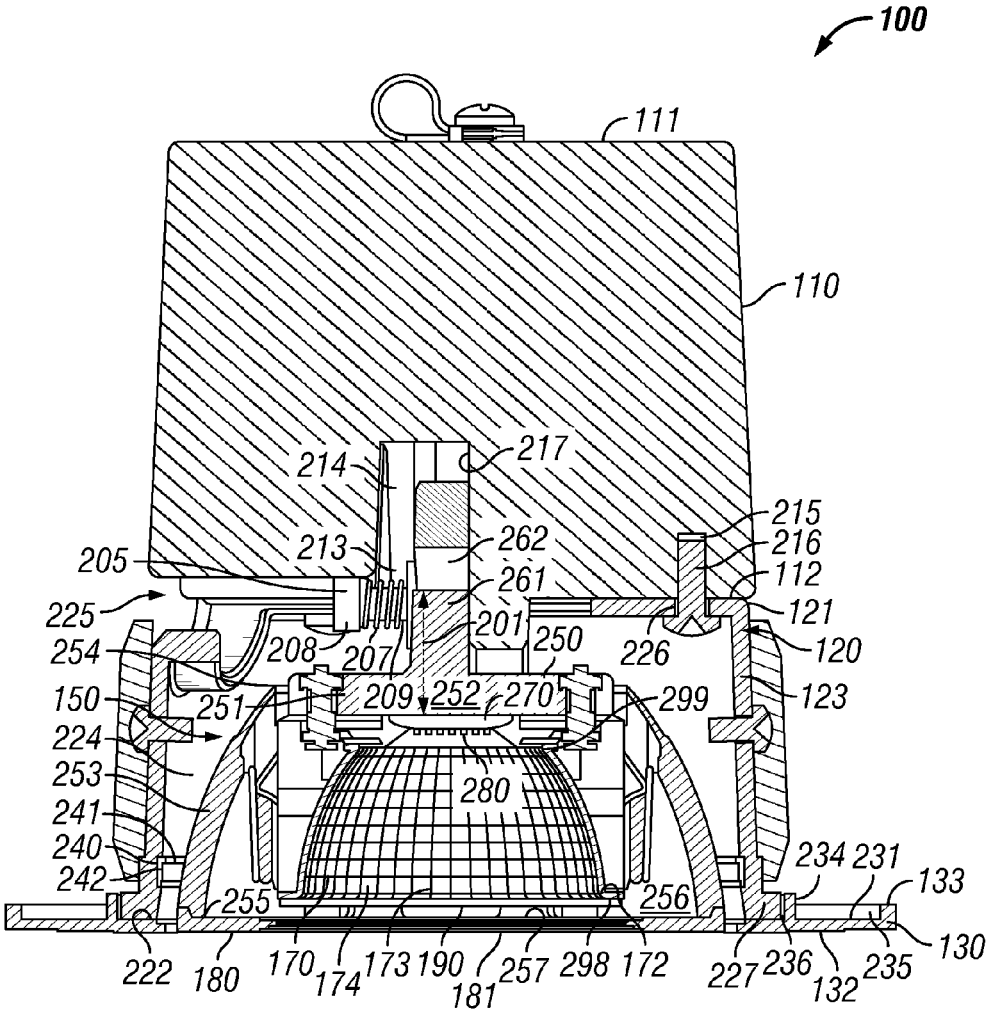
FIG. 2A is a cross-sectional view of the luminaire of FIG. 1 according to an exemplary embodiment of the present invention.
Figure 2B:
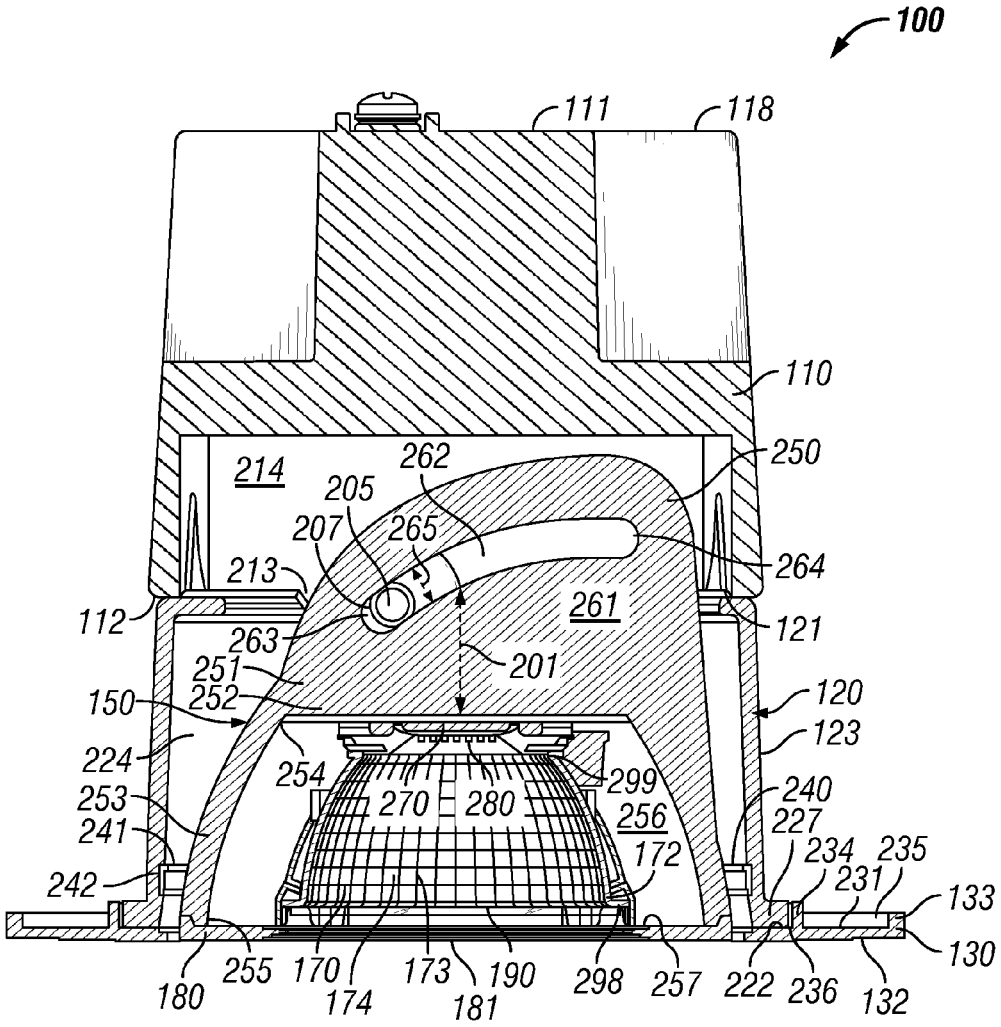
FIG. 2B is another cross-sectional view of the luminaire of FIG. 1 according to an exemplary embodiment of the present invention.

FIGS. 1, 2A, and 2B are various views of a luminaire 100 according to an exemplary embodiment of the present invention. Referring to FIGS. 1, 2A, and 2B, the luminaire 100 includes an upper heat sink 110, an outer trim ring 130, and an LED module 150 directionally adjustable with respect to at least the upper heat sink 110 and the outer trim ring 130, which are described in further detail below. According to certain exemplary embodiments, the luminaire 100 also includes a fastening device 205 and a spring 207 for coupling the LED module 150 to the upper heat sink 110, which is described in further detail below. According to some exemplary embodiments, the luminaire 100 also includes a lower heat sink 120 coupled to the upper heat sink 110 and a snap ring 240 disposed between the lower portion of the lower heat sink 120 and the LED module 150, both of which are described in further detail below. The upper heat sink 110 and the lower heat sink 120 are individually, or collectively, referred to as a stationary heat sink. Although not illustrated, the luminaire 100 is insertable into a housing (not shown), such as a downlight can housing, that is installed within a support structure, such as a ceiling. The stationary heat sink 110, 120 is positionable into a cavity (not shown) formed within the housing and occupies substantially the entire diameter of the cavity according to some exemplary embodiments.

The upper heat sink 110 includes a top end 111 and a bottom end 112. The upper heat sink 110 also includes one or more fins 118 extending from an interior portion of the upper heat sink 110 to an outer vertical periphery of the upper heat sink 110. According to one exemplary embodiment, the fins 118 are integrally formed with the upper heat sink 110 during casting of the upper heat sink 110. Alternatively, the fins 118 are coupled to the interior portion of the upper heat sink 110 subsequent to its fabrication using methods known to people having ordinary skill in the art. According to one exemplary embodiment, the fins 118 extend substantially from the top end 111 to the bottom end 112. Alternatively, the fins 118 extend a portion of the distance between the top end 111 and the bottom end 112. The fins 118 extend substantially parallel to one another forming a gap 119 between adjacent fins 118 according to some exemplary embodiments. In other exemplary embodiments, the fins 118 extend radially around the upper heat sink 110, also forming gaps 119 between adjacently positioned fins 118. The bottom end 112 defines an opening 213 which extends into the upper heat sink 110; thereby forming a cavity 214 within the upper heat sink 110 and is surrounded by an interior wall 217 of the upper heat sink. The opening 213 and the cavity 214 are formed during the casting process of the upper heat sink 110 according to certain exemplary embodiments. Alternatively, the opening 213 and the cavity 214 are formed by machining into the bottom end 112 of the upper heat sink 110, or by other methods known to people having ordinary skill in the art. The exemplary cavity 214 is substantially rectangular in shape. In alternative exemplary embodiments, the cavity 214 has other geometric shapes or non-geometric shapes. Although not illustrated, the interior wall 217 includes a first aperture (not shown) for receiving a portion of the fastening device 205, which is discussed in further detail below. The first aperture is formed during the casting process of the upper heat sink 110 according to certain exemplary embodiments. Alternatively, the first aperture is formed by machining into the interior wall 217 of the upper heat sink 110, or by other methods known to people having ordinary skill in the art. The bottom end 112 also includes one or more second apertures 215 for receiving a coupling device 116, which also is discussed in further detail below. The second aperture is formed during the casting process of the upper heat sink 110 according to certain exemplary embodiments. Alternatively, the second aperture is formed by machining into the bottom end 112 of the upper heat sink 110, or by other methods known to people having ordinary skill in the art. The upper heat sink 110 is fabricated using a thermally conductive, rigid material, such as a polymer, metal, or metal alloy. One example of the material used to fabricate the upper heat sink 110 is aluminum.

The lower heat sink 120 includes a top end 121, a bottom end 222 positioned opposite of the top end 121, a sidewall 123 extending from the top end 121 to the bottom end 222, and a cavity 224 extending from the top end 121 to the bottom end 222 and substantially surrounded by the sidewall 123. The cavity 224 is formed during the casting of the lower heat sink 120 according to some exemplary embodiments. Alternatively, the cavity 224 is formed by machining through at least a portion of the top end and continuously through at least a portion of the bottom end 222 of the lower heat sink 120, or by other methods known to people having ordinary skill in the art. A portion of the sidewall 123, adjacent and inclusive to a portion of the top end 121, includes a first opening 225 for providing access for manipulating, either inserting, removing, loosening, and/or tightening, at least the fastening device 205, which is discussed in further detail below. The first opening 225 is dimensioned to at least the outer diameter of the fastening device 205 and extends laterally into the cavity 224. The first opening 225 is horizontally aligned with the fastening device 205 once the fastening device 205 is installed within the cavity 224, which is described in further detail below. According to some exemplary embodiments, the first opening 225 is formed only within a portion of the sidewall 123. The top end 121 includes one or more second openings 226 for receiving the coupling device 216, for example a screw, to couple the lower heat sink 120 to the upper heat sink 110. The second openings 226 are vertically aligned with the second apertures 215 when the lower heat sink 120 is coupled to the upper heat sink 110. The sidewall 123 adjacent to the bottom end 222 includes a flange 227 that extends radially outward from and substantially perpendicular to the sidewall 123 at the bottom end 222. The flange 227 facilitates coupling of the lower heat sink 120 with the outer trim ring 130 according to some exemplary embodiments. According to some exemplary embodiments, the sidewall 123 includes a notched or hollowed out portion extending along the inner circumference of the sidewall 123 and defining a channel 328 (FIG. 3) near and above the flange 227. The exemplary lower heat sink 120 is fabricated using a thermally conductive, rigid material, such as a polymer, metal, or metal alloy. One example of the material used to fabricate the lower heat sink 120 is aluminum.

The lower heat sink 120 is coupled to the upper heat sink 110 using the coupling device 216. The lower heat sink's second openings 226 are vertically aligned with the upper heat sink's second apertures 215 and each coupling device 216 is inserted through a respective lower heat sink's second opening 226 and upper heat sink's second aperture 215. Although one example has been illustrated for coupling the lower heat sink 120 to the upper heat sink 110, other exemplary embodiments can couple the lower heat sink 120 to the upper heat sink 110 using other methods known to people having ordinary skill in the art. In alternative embodiments, the lower heat sink 120 and the upper heat sink 110 are fabricated or casted as a single component. Upon coupling the lower heat sink 120 to the upper heat sink 110, a portion of the upper heat sink 110 that includes the first aperture is inserted into the cavity 224 of the lower heat sink 120 so that the first aperture of the upper heat sink 110 is horizontally aligned with the first opening 225 of the lower heat sink 120.

The LED module 150 includes a gimbal 250, a substrate 270, and one or more LEDs 280 coupled to the substrate 270. The LED module 150 also includes a reflector 170 and an inner trim ring 180 according to certain other exemplary embodiments. In certain exemplary embodiments, the LED module 150 also includes a lens 190.

The gimbal 250, also referred to as a second heat sink, includes a first portion 251 and a second portion 261 that are fabricated as a single component according to some exemplary embodiments. Alternatively, the first portion 251 and the second portion 261 are fabricated as separate components and thereafter coupled to one another according to methods known to people having ordinary skill in the art. The second portion 261 extends from the first portion 151 in a generally vertically upward manner once the gimbal 250 is coupled to the upper heat sink 110. The first portion 251 is substantially parabolic-shaped and includes a base portion 252 that is adjacent to a portion of the second portion 261, a sidewall 253 having an adjacent end 254 and a distal end 255, and a cavity 256 within the first portion and surrounded by the sidewall 253. Although the first portion 251 is substantially parabolic-shaped, the first portion 251 is shaped into other geometric or non-geometric shapes in other exemplary embodiments. The base portion 252 is substantially planar according to some exemplary embodiments. The sidewall 253 extends from the base portion 252, where the adjacent end 254 is positioned substantially around the circumference of the base portion 252 and the distal end 255 extends in a direction towards the desired illumination area, in a direction substantially opposite of the direction in which the second portion 261 extends. The distal end 255 defines an opening 257. The sidewall 253 includes a notched or hollowed out portion extending along the outer circumference of the sidewall 253 and defining a channel 358 (FIG. 3) near and above the distal end 255. However, according to other exemplary embodiments, the sidewall 253 defines a channel 358 (FIG. 3) extending around one or more portions of the outer surface of the sidewall 253 near and above the distal end 255. According to some exemplary embodiments, one or more apertures 359 (FIG. 3) are formed within a portion of the channel 358 (FIG. 3) and facilitate coupling the LED module 150 to a snap ring 240 (FIG. 3), which is described in further detail below. The apertures 359 (FIG. 3) extend laterally into the cavity 256. The cavity 256 is formed during the casting process of the gimbal 250 according to certain exemplary embodiments. Alternatively, the cavity 256 is formed by machining into the gimbal 250, or by other methods known to people having ordinary skill in the art.

The second portion 261 extends from the base portion 252 of the first portion 251 in a direction substantially opposite of the location of the cavity 256 according to some exemplary embodiments. According to other exemplary embodiments, the second portion also extends from at least a portion of the sidewall 253 of the first portion 251. The second portion 261 has a front-profile that is substantially rectangularly shaped, as seen in FIG. 2A, and has a side-profile that includes an arcuately-shaped upper portion, as seen in FIG. 2B. According to some exemplary embodiments, the radius of curvature for the arcuately-shaped upper portion of the second portion 261 is about 2.59 inches; however, this radius of curvature is variable depending upon design choices. Additionally the centerpoint of the upper portion's radius of curvature is the centerpoint of the aperture 359 (FIG. 3) according to certain exemplary embodiments. The second portion is dimensioned so that at least a portion of the second portion 261 is insertable into the cavity 214 of the upper heat sink 110. The second portion 261 includes a slot 262 that is machined therein and which extends arcuately when viewed from the side cross-sectional view, as illustrated in FIG. 2B. According to some exemplary embodiments, the radius of curvature for the arcuately-shaped slot 262 is about 2⅛ inches; however, this radius of curvature is variable depending upon design choices. Additionally the centerpoint of the slot's radius of curvature is the centerpoint of the aperture 359 (FIG. 3) according to certain exemplary embodiments. The slot 262 includes a first end 263 and a second end 264, where the first end 263 is positioned elevationally lower than the second end 264 according to some exemplary embodiments. The slot 262 proceeds elevationally higher as it extends from the first end 263 to the second end 264; however, the slot 262 can proceed in a different manner as it extends form the first end 263 to the second end 264 in other exemplary embodiments. The slot 262 is dimensioned to have a width 265 that is larger than the diameter of a rod portion 209 of the fastening device 205, but smaller than the diameter of a head portion 208 of the fastening device 205, which is explained in further detail below in conjunction with the description provided for the coupling of the LED module 150 to the upper heat sink 110. According to one example, the width 265 is about 0.23 inches; however, the width 265 is larger or smaller depending upon the design choices. The gimbal 250 is fabricated using a thermally conductive material, such as a polymer, metal, or metal alloy. One example of the material used to fabricate the gimbal 250 is aluminum.

According to some exemplary embodiments, the substrate 270 includes one or more sheets of ceramic, metal, laminate, circuit board, Mylar®, or another material and is coupled to the base portion 252 of the gimbal 250 within the cavity 256. Each LED 280 is electrically coupled to the substrate 270 and includes a chip of semi-conductive material that is treated to create a positive-negative ("p-n") junction. When the LED 280 or LED package is electrically coupled to a power source, such as an LED driver (not shown), current flows from the positive side to the negative side of each junction, causing charge carriers to release energy in the form of incoherent light.

The wavelength or color of the emitted light depends on the materials used to make the LED 280 or LED package. For example, a blue or ultraviolet LED typically includes gallium nitride ("GaN") or indium gallium nitride ("InGaN"), a red LED typically includes aluminum gallium arsenide ("AlGaAs"), and a green LED typically includes aluminum gallium phosphide ("AlGaP"). Each of the LEDs 280 in the LED package can produce the same or a distinct color of light. For example, in certain exemplary embodiments, the LED package include one or more white LED's and one or more non-white LEDs, such as red, yellow, amber, or blue LEDs, for adjusting the color temperature output of the light emitted from the luminaire 100. A yellow or multi-chromatic phosphor may coat or otherwise be used in a blue or ultraviolet LED to create blue and red-shifted light that essentially matches blackbody radiation. The emitted light approximates or emulates "white," incandescent light to a human observer. In certain exemplary embodiments, the emitted light includes substantially white light that seems slightly blue, green, red, yellow, orange, or some other color or tint. In certain exemplary embodiments, the light emitted from the LEDs has a color temperature between 2500 and 5000 degrees Kelvin.

In certain exemplary embodiments, an optically transmissive or clear material (not shown) encapsulates at least a portion of each LED 280 or LED package. This encapsulating material provides environmental protection while transmitting light from the LEDs 280. In certain exemplary embodiments, the encapsulating material includes a conformal coating, a silicone gel, a cured/curable polymer, an adhesive, or some other material known to a person of ordinary skill in the art having the benefit of the present disclosure. In certain exemplary embodiments, phosphors are coated onto or dispersed in the encapsulating material for creating white light. In certain exemplary embodiments, the white light has a color temperature between 2500 and 5000 degrees Kelvin.

In certain exemplary embodiments, the LED 280 is an LED package that includes one or more arrays of LEDs 280 that are collectively configured to produce a lumen output from 1 lumen to 5000 lumens. The LEDs 280 or the LED packages are attached to the substrate 270 by one or more solder joints, plugs, epoxy or bonding lines, and/or other means for mounting an electrical/optical device on a surface. The substrate 270 is electrically connected to support circuitry (not shown) and/or the LED driver for supplying electrical power and control to the LEDs 280 or LED packages. For example, one or more wires (not shown) couple opposite ends of the substrate 270 to the LED driver, thereby completing a circuit between the LED driver, substrate 270, and LEDs 280. In certain exemplary embodiments, the LED driver is configured to separately control one or more portions of the LEDs 280 in the array to adjust light color or intensity of the light that is emitted through the opening 257.

According to some exemplary embodiments, the reflector 170 is parabolic-shaped and has a proximal end 299 and a distal end 172. As shown in this exemplary embodiment, the proximal end 299 is coupled to a mounting member, such as the substrate 270 or the base portion 252 of the gimbal 250. In one exemplary embodiment, a flange 298 is formed at the distal end 172 and extends in a radially outward direction from the distal end 172 of the reflector 170. In certain exemplary embodiments, the flange 298 facilitates the coupling of the lens 190 to the reflector 170. The parabolic-shaped reflector 170 focuses the light emitted by the LEDs 280 to create a beam of light. Although this exemplary embodiment depicts a parabolic-shaped reflector 170, other geometric or non-geometric shaped reflectors known to people having ordinary skill in the art are within the scope and spirit of the exemplary embodiment. The proximal end 299 of the reflector 170 is disposed around the LEDs 280, while the distal end 172 extends in a direction towards the desired illumination area once the luminaire 100 is mounted to the support structure. The reflector 170 includes an internal surface 173 extending from the proximal end 299 to the distal end 172, which is reflective. The internal surface 173 includes multiple facets 174 extending longitudinally along and radially around the internal surface 173 according to some exemplary embodiments. Alternatively, according to other exemplary embodiments, the internal surface 173 is entirely smooth, at least partially smooth, or includes prismatic elements, dimples, or other known light diffusing elements. The reflector 170 is fabricated using a reflective material, such as polished metal. Alternatively, the reflector 170 is fabricated using a non-reflective material and subsequently has its internal surface 173 made to be reflective using methods known to people having ordinary skill in the art, such as by painting the internal surface 173 with white reflective paint.

According to some exemplary embodiments, the lens 190 is coupled to the flange 298 of the reflector 170. According to some exemplary embodiments, the lens 190 is fastened to the flange 298 using screws; however, other fastening devices, such as clips, can be used in other exemplary embodiments. The lens 190 is fabricated using a transparent or translucent material, such as glass or plastic, which allows light generated from the LEDs 280 to pass therethrough. According to some exemplary embodiments, the lens 190 is smooth; however, other exemplary embodiments utilize a lens 190 that includes micro-patterns, dimples, prismatic elements, and/or other known light diffusing elements. The lens 190 provides protection to the LEDs 280 from dust and other contaminants when used.

The inner trim ring 180 is ring-shaped and includes an opening 181 formed substantially through the middle of the inner trim ring 180. The opening 181 is formed during the fabrication of the inner trim ring 180. Alternatively, the opening 181 is formed by machining through the inner trim ring 180. According to other exemplary embodiments, the inner trim ring 180 is shaped into other geometric or non-geometric forms. The outer circumference of the inner trim ring 180 is coupled to the distal end 255 of the gimbal's first portion's sidewall 253. The inner trim ring 180 is coupled to the sidewall 253 according to methods known to people having ordinary skill in the art. Once the inner trim ring 180 is coupled to the sidewall 253, the circumference of the opening 181 is substantially vertically aligned with the reflector's distal end 172. The light emitted from the LEDs 280 is emitted through opening 181 prior to illuminating the desired illumination surface. The inner trim ring 180 is fabricated using a thermally conductive material, such as a polymer, metal, or metal alloy. One example of the material used to fabricate the inner trim ring 180 is aluminum.

The LED module 150 is adjustably coupled to the upper heat sink 110 using the fastening device 205 and the spring 207, as previously mentioned. Although the fastening device 205 and the spring 207 are used to couple the LED module 150 to the upper heat sink 110, other devices can be used without departing from the scope and spirit of the exemplary embodiment. Also, although the fastening device 205 and the spring 207 are used to couple the LED module 150 to the upper heat sink 110, the LED module 150 can be coupled to the lower heat sink 120 without departing from the scope and spirit of the exemplary embodiment. According to certain exemplary embodiments, the fastening device 205 includes the head portion 208 and the rod portion 209 extending outwardly from the head portion 208. The rod portion 209, according to some exemplary embodiments, is at least partially threaded at its end positioned away from the head portion 208. The head portion 208 is substantially cylindrically shaped, but can be shaped into other geometric or non-geometric shapes. The head portion 208 has an outer perimeter that is greater than the outer perimeter of the rod portion 209. The spring 207 has an inner perimeter that is similar or greater than the outer perimeter of the rod portion 209, but has an outer perimeter that is less than the outer perimeter of the head portion 208. The rod portion 209 is inserted through the spring 207 such that the spring surrounds at least a portion of the rod portion 209. The diameter of the outer perimeter of the spring 207 is greater than the width 265 of the slot 262. The diameter of the outer perimeter of at least a portion of the rod portion 209 is less than the width 265 of the slot 262. The fastening device 205, with the spring 207 surrounding at least a portion of the rod portion 209, is inserted through the first opening 225 of the lower heat sink 120. Once inserted through the first opening 225, the rod portion 209 is inserted at least partially through the slot 262 and into the first aperture formed within the upper heat sink 110. The first aperture also is threaded, according to some exemplary embodiments, to receive at least the threaded portion of the rod portion 209. Once the fastening device 205 couples the LED module 150 to the upper heat sink 110, the spring 207 is positioned between the head portion 208 of the fastening device 205 and the slot 262. The spring 207 exerts a force onto the LED module 150 so as to maintain contact, and hence a thermal conduction pathway, between at least a portion of the LED module 150 and the upper heat sink 110.

As shown in FIG. 2B, the LED module 150 is oriented at a zero degree angle, which is when the inner trim ring 180 lies in about the same plane as the outer trim ring 130. According to some of the exemplary embodiments, the LED module 150 is directionally adjustable from an angle ranging from about −3 degrees to about thirty-eight degrees. However, this angle ranges from about −45 degrees to about forty-five degrees and is dependent upon the length and shape of the slot 262 and the location of where the fastening device 205 is installed along the length of the slot 262. To change the orientation of the LED module 150, the fastening device 205 is slidably positioned within a different location along the slot 262. This change in orientation is achievable, for example, by exerting a force on at least a portion of the inner trim ring 180. According to the embodiment shown, the LED module 150 is oriented at a −3 degree angle when the fastening device 205 is positioned at the first end 263 of the slot 262 and is oriented at a thirty eight degree angle when the fastening device 205 is positioned at the second end 264 of the slot 262. When the LED module 150 is directionally adjusted, the upper and lower heat sinks 110, 120 remain stationary and a portion of the gimbal 250 maintains contact with the upper heat sink 110 during and upon completion of the adjustment. Also, when the LED module 150 is directionally adjusted, the outer trim ring remains stationary.

Figure 3:
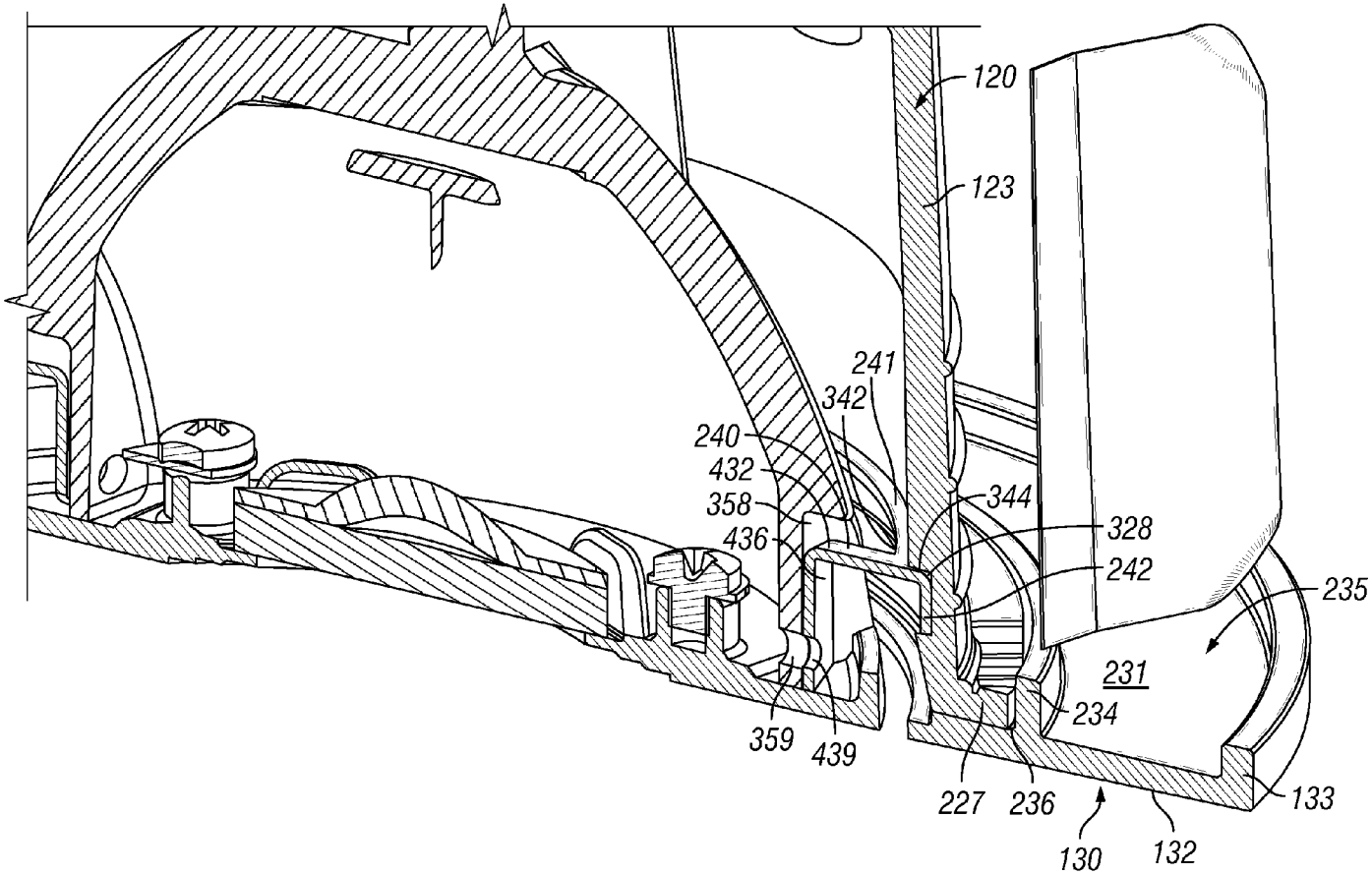
FIG. 3 is a partial perspective, cross-sectional view of the lower portion of the luminaire of FIG. 1 according to an exemplary embodiment of the present invention.

FIG. 3 is a partial perspective, cross-sectional view of the lower portion of the luminaire 100 according to an exemplary embodiment of the present invention. Referring to FIGS. 1-3, the outer trim ring 130 is ring-shaped and includes a top surface 231 and a bottom surface 132. However, according to other exemplary embodiments, the outer trim ring 130 is shaped into another geometric or non-geometric form. According to some exemplary embodiments, the top surface 231 includes a first wall 133 and a second wall 234 both extending substantially perpendicular to the top surface 231 and extending radially around the entire top surface 231. Although the first wall 133 and the second wall 234 both extend substantially perpendicular to the top surface 231, one or more of the first wall 133 and the second wall 234 extend substantially non-perpendicular to the top surface 231. According to some other exemplary embodiments, one or more of the first wall 133 and the second wall 234 extend radially around one or more portions of the top surface 231. According to some exemplary embodiments, the first wall 133 is positioned substantially around the outer perimeter of the outer trim ring 130 and the second wall 234 is positioned between the outer perimeter and the inner perimeter of the outer trim ring 130. According to some exemplary embodiments, the second wall 234 is positioned closer to the inner perimeter of the outer trim ring 130 than the outer perimeter of the outer trim ring 130. According to some exemplary embodiments, the first wall 133 and the second wall 234 are formed in a concentric manner. A first channel 235 is formed between the first wall 133 and the second wall 234. A second channel 236 is formed between the second wall 234 and the inner perimeter of the outer trim ring 130. The bottom surface 132 is substantially planar according to some exemplary embodiments; however, the bottom surface 132 is non-planar according to alternative exemplary embodiments. Once the luminaire 100 is installed into a support structure, the bottom surface 132 of the outer trim ring 130 is oriented to face the desired illumination area and is observable to one present within the desired illumination area. The outer trim ring 130 is fabricated using a thermally conductive material, such as a polymer, metal, or metal alloy. One example of the material used to fabricate the outer trim ring 130 is aluminum.

The lower heat sink 120 is coupled to the outer trim ring 130 by inserting the flange 227 of the lower heat sink 120 into the second channel 236 and coupling the flange 227 to the outer trim ring 130 according to methods known to people having ordinary skill in the art. Some methods available for coupling the flange 227 to the outer trim ring 130 include, but are not limited to, friction-fit, snap-fit, or using fastening devices, such as tabs. The outer trim ring 130 and the lower heat sink 120 are fabricated as a single component according to other exemplary embodiments. The outer trim ring 130, the lower heat sink 120, and the upper heat sink 110 are fabricated as a single component in yet other exemplary embodiments.

Figure 4:
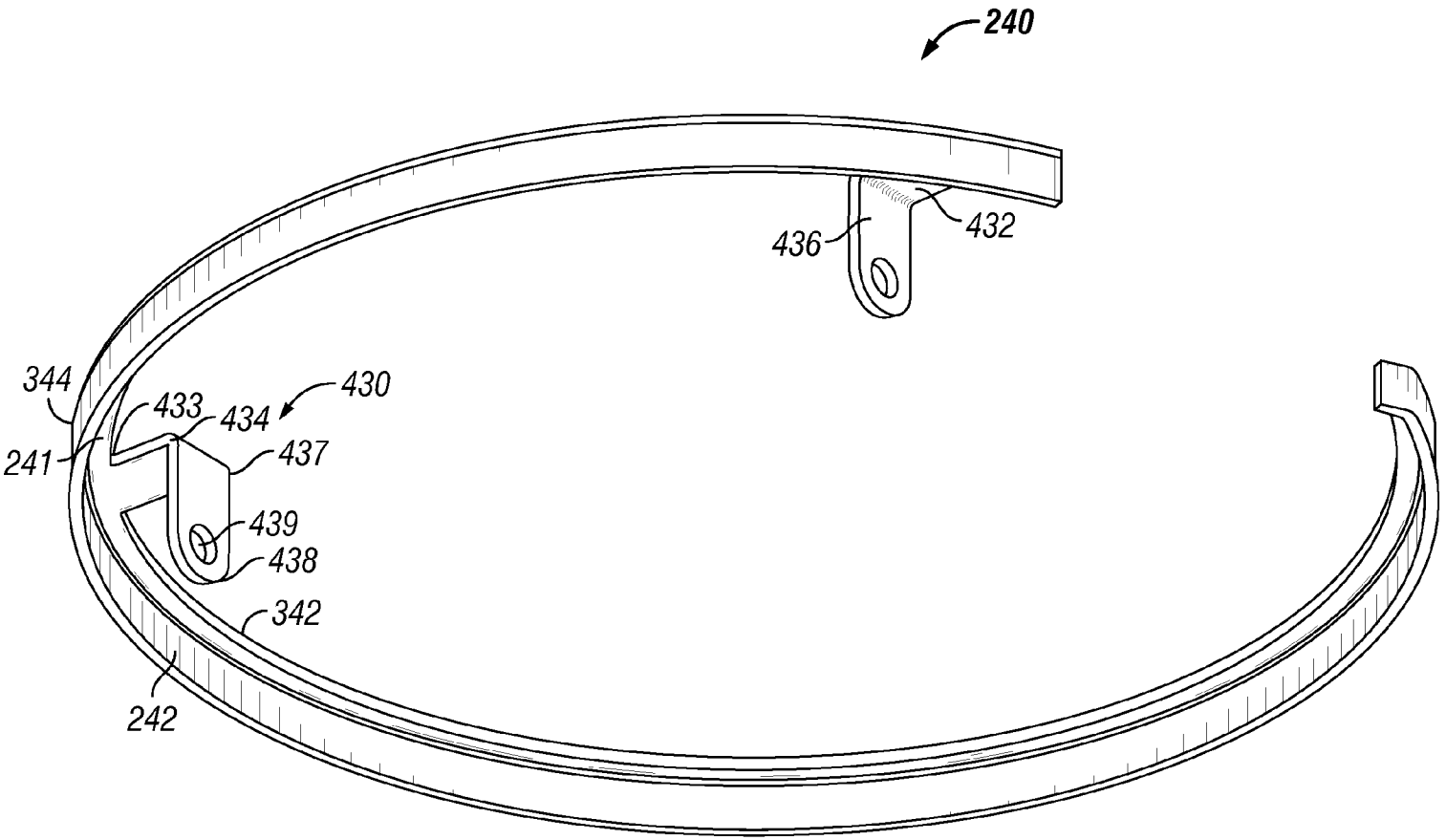
FIG. 4 is a perspective view of the snap ring of FIG. 3 according to an exemplary embodiment of the present invention.

FIG. 4 is a perspective view of the snap ring 240 of FIG. 3 according to an exemplary embodiment of the present invention. Referring to FIGS. 2A-4, the snap ring 240 is substantially ring-shaped and includes a planar portion 241 having an interior perimeter 342 and an exterior perimeter 344. A wall 242 extends substantially perpendicularly to the planar portion 241 along the exterior perimeter 344. A coupling device 430 includes a first portion 432 and a second portion 436 that extends substantially perpendicular to the first portion 432. The first portion includes a first end 433 and a second end 434. The first portion 432 is oriented substantially in the same plane as the planar portion 241. The first end 433 is coupled adjacently to the interior perimeter 342 of the planar portion 241 and the second end 434 is positioned interior of the snap ring 240. The second portion 436 includes a first end 437 and a second end 438. The first end 437 is coupled adjacently to the second end 434 of the first portion 432. The second portion 436 extends perpendicular to the first portion 432 such that a portion of the second portion 436 faces a portion of the wall 242. Adjacent to the second end 438, the second portion 436 includes an aperture 439 formed therein to facilitate coupling of the snap ring 240 to the LED module 250. The aperture 439, according to one example, is formed by machining through a portion of the second portion 436. According to some exemplary embodiments, two coupling devices 430 are coupled radially around the snap ring 240; however, the number of coupling devices 430 can vary in other exemplary embodiments. The coupling devices 430 are distanced apart so that the apertures 439 become horizontally aligned with the apertures 359 of the gimbal 250 when the snap ring 240 is coupled to the gimbal 250. The snap ring 240 is fabricated as a single component; however, the snap ring 240 can be fabricated in several components and thereafter assembled together. The snap ring 240 is fabricated using a polymer material, metal, or metal alloy; however, other suitable materials known to people having ordinary skill in the art can be used.

The snap ring 240 is installed in the luminaire 100 between the LED module 150 and the lower heat sink 120. Specifically, the second portion 436 of the snap ring's coupling device 430 is inserted into the channel 358 of the gimbal's sidewall 253 such that the apertures 359 formed within the channel 358 are horizontally aligned with the apertures 439 formed in the snap ring 240. Thus, a fastening device (not shown), such as a screw or pin, is inserted into the aligned apertures 359, 439 to pivotably couple the LED module 150 to the lower heat sink 110. The snap ring's wall 242 is inserted into the channel 328 of the lower heat sink's sidewall 123. The snap ring 240 provides an alignment feature, or spacing feature, between the lower portion of the LED module 150 and the lower portion of the lower heat sink 120. The snap ring 240 also provides the pivoting feature between the lower portion of the LED module 150 and the lower portion of the lower heat sink 120.

Referring to FIGS. 2A and 2B, the heat generated from the LEDs 280 is removed from the luminaire 100 in several pathways according to some exemplary embodiments. One pathway includes the heat from the LEDs 280 traveling from the LEDs 280, through the substrate 270, into the base portion 252 of the gimbal 250, through the sidewall 253, into the inner trim ring 180, and out into the surrounding environment where the light from the LEDs 280 is being directed. Another pathway includes the heat from the LEDs 280 traveling from the LEDs 280, through the substrate 270, into the base portion 252 of the gimbal 250, up the second portion 261 of the gimbal 250, through an interface 202 located between the gimbal 250 and the upper heat sink 110, through the upper heat sink 110, into the environment surrounding the upper heat sink 110, and eventually into a space, such as an attic, located above the luminaire 100. The interface 202 is formed at the continuous contact formed between the gimbal 250 and the upper heat sink 110 regardless of the orientation of the LED module 150 with respect to the stationary heat sink 110, 120. Another pathway includes the heat from the LEDs 280 traveling from the LEDs 280, through the substrate 270, into the base portion 252 of the gimbal 250, up the second portion 261 of the gimbal 250, through the interface 202 located between the gimbal 250 and the upper heat sink 110, through the upper heat sink 110, into the lower heat sink 120 contacting the upper heat sink 110, down the sidewall 123 of the lower heat sink 120, into the outer trim ring 130, and out into the surrounding environment where the light from the LEDs 280 is being directed. Although some heat removal pathways have been described above, other heat removal pathways do exist.

Figure 5A:
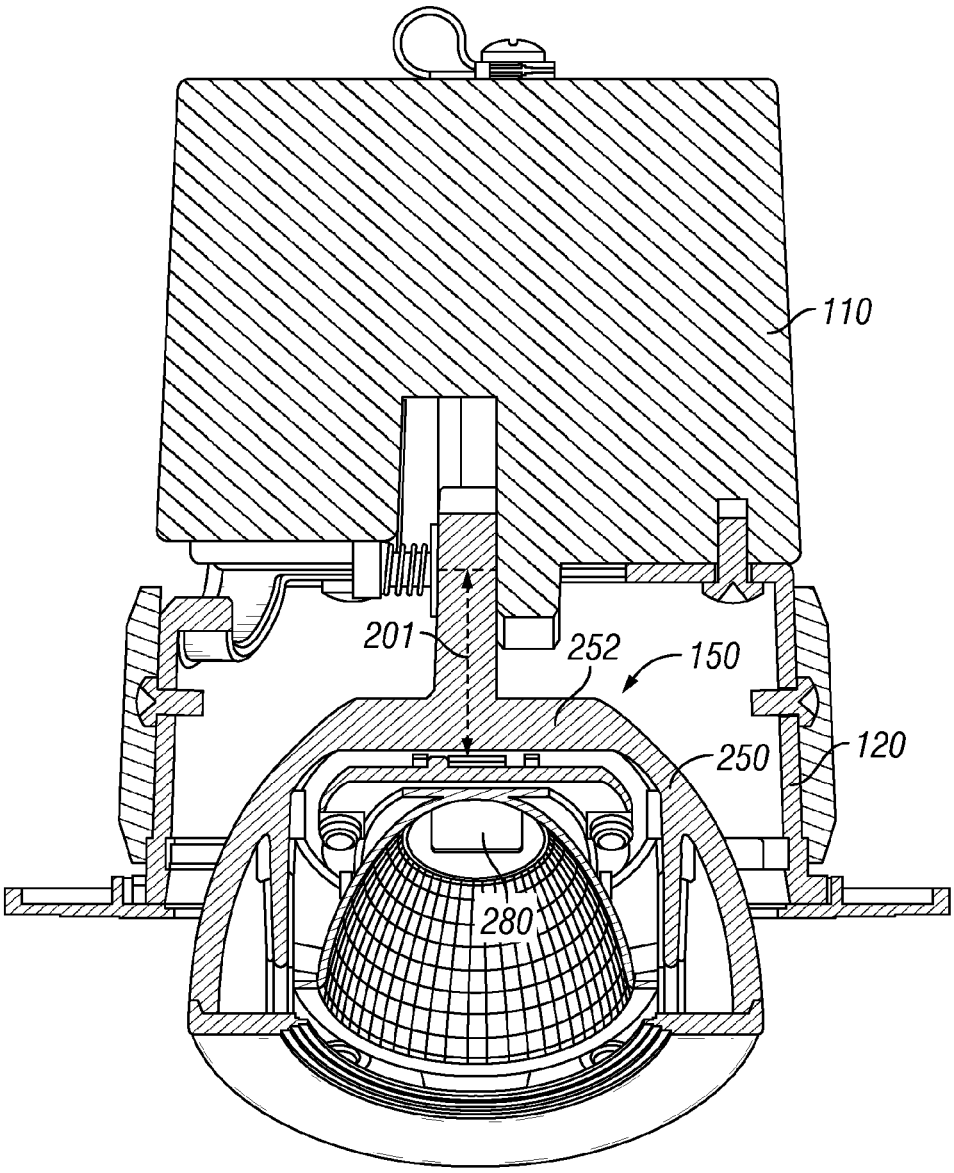
FIG. 5A is a perspective view of the luminaire of FIG. 1 with the LED module being angularly positioned according to an exemplary embodiment of the present invention.
Figure 5B:
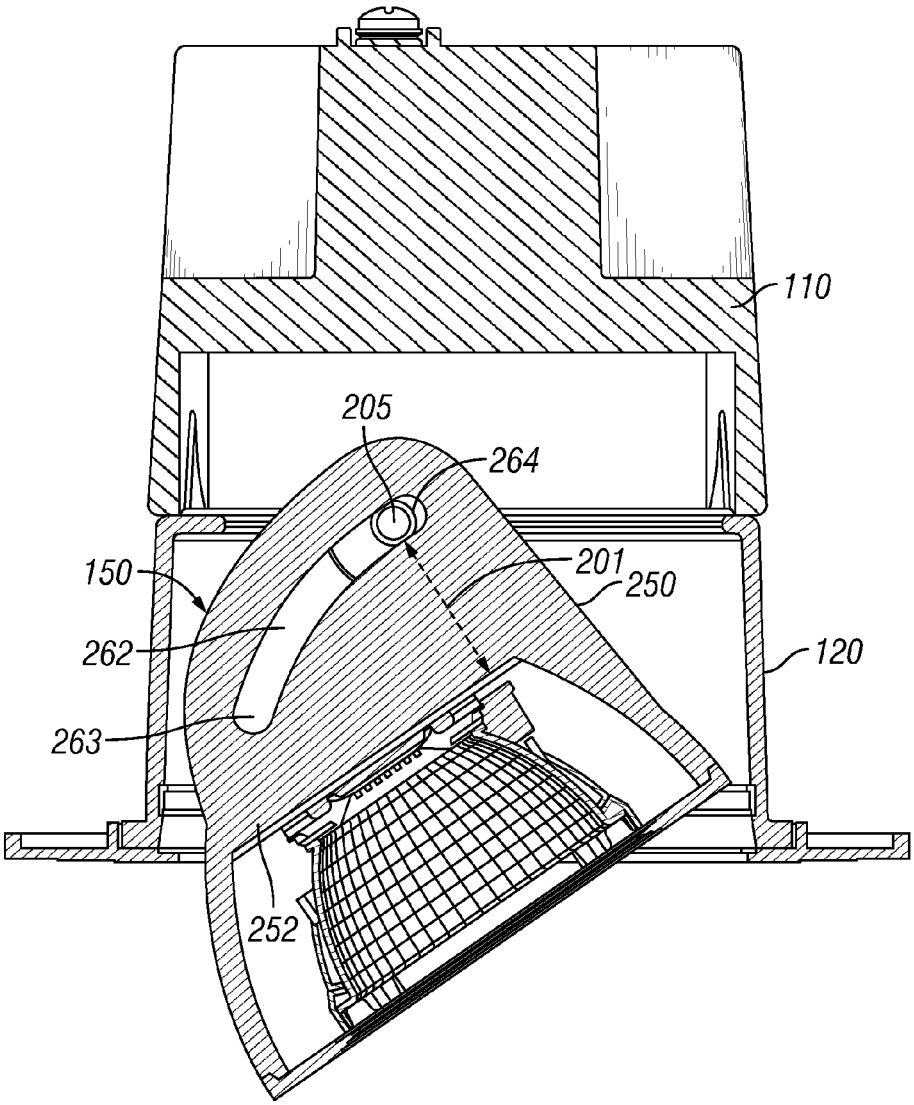
FIG. 5B is a cross-sectional view of the luminaire of FIG. 5A according to an exemplary embodiment of the present invention.
Figure 5C:
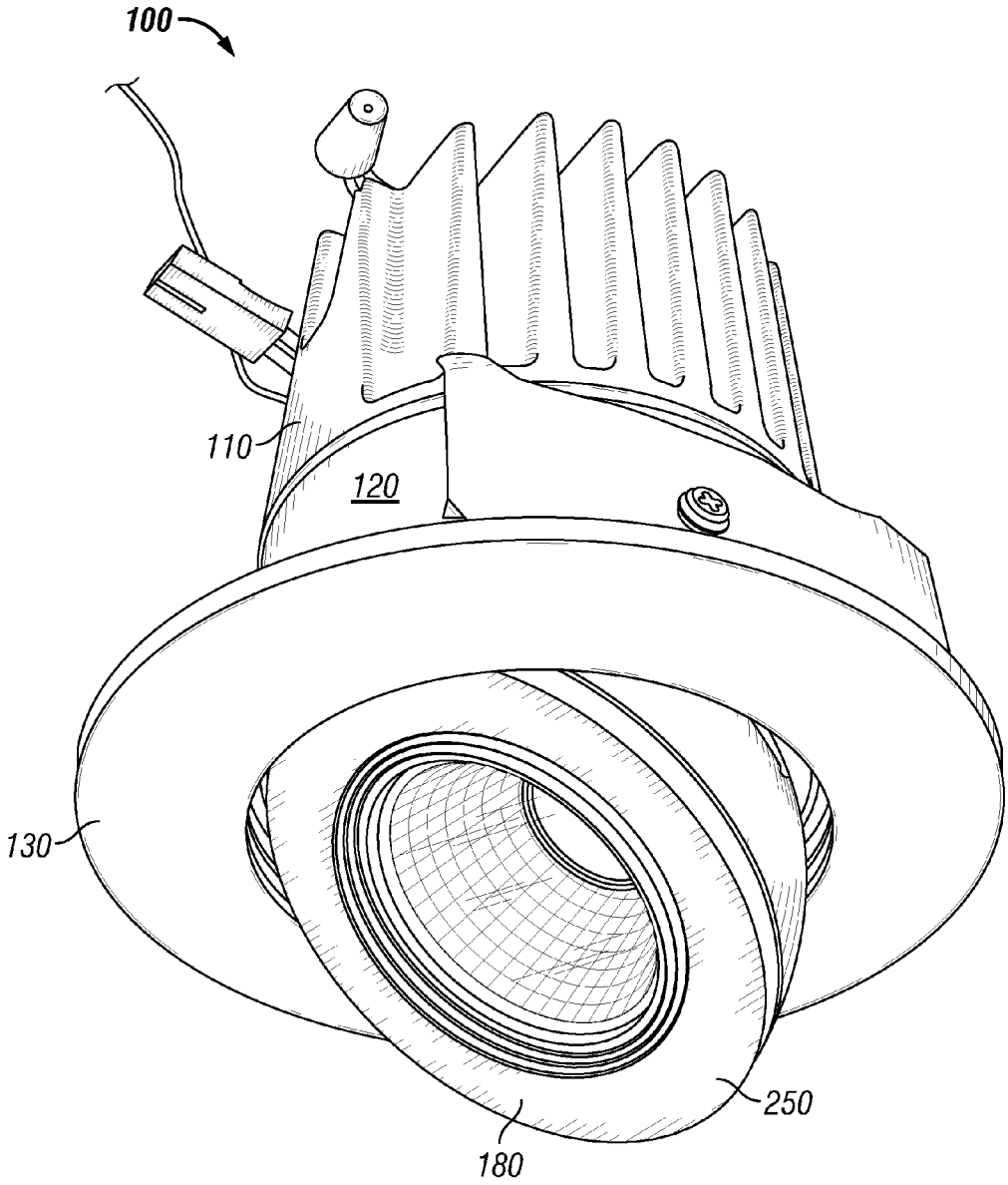
FIG. 5C is another cross-sectional view of the luminaire of FIG. 5A according to an exemplary embodiment of the present invention.

FIGS. 5A-5C provide several views of the luminaire 100 with the LED module 150 being angularly positioned according to an exemplary embodiment of the present invention. Referring to FIGS. 5A-5C, a portion of the gimbal 250 recedes into the lower heat sink 120, while another portion of the gimbal 250 is exposed outside the lower heat sink 120 and into the surrounding environment when the LED module 150 is oriented at an angle other than zero degrees. Thus, an observer within the illuminated area is able to view a greater portion of the gimbal 250 as the gimbal 250 is oriented at greater angles. As the fastening device 205 moves from the first end 263 of the slot 262 to the second end 264 of the slot, a thermal pathway distance 201, located within the gimbal 250, extending from the base portion 252 to the slot 262 is increased. The heat generated from the LEDs 280, when the gimbal 250 is angularly positioned, travels through the longer thermal pathway distance 201 and hence takes longer to dissipate the heat through the upper heat sink 110. However, since a portion of the gimbal 250 is exposed outside the lower heat sink 120 and into the surrounding environment, more heat generated from the LEDs 280 is dissipated from the gimbal 250 directly to the surrounding environment where the light from the LEDs 280 is being directed. Thus, as the gimbal 250 is angularly positioned at a greater angle, a greater portion of the gimbal 250 is exposed into the surrounding environment, hence making heat dissipation more efficient eventhough the thermal pathway distance 201 is increased.

Although the invention has been described with reference to specific embodiments, these descriptions are not meant to be construed in a limiting sense. Various modifications of the disclosed embodiments, as well as alternative embodiments of the invention will become apparent to persons of ordinary skill in the art upon reference to the description of the exemplary embodiments. It should be appreciated by those of ordinary skill in the art that the conception and the specific embodiments disclosed may be readily utilized as a basis for modifying or designing other structures or methods for carrying out the same purposes of the invention. It should also be realized by those of ordinary skill in the art that such equivalent constructions do not depart from the spirit and scope of the invention as set forth in the appended claims. It is therefore, contemplated that the claims will cover any such modifications or embodiments that fall within the scope of the invention.

What is claimed is:

1. A luminaire, comprising:

a stationary heat sink comprising a distal end and a sidewall extending substantially orthogonally away from the distal end, the sidewall forming an opening within the stationary heat sink and extending from the distal end;

a rotatably adjustable LED module comprising:

a second heat sink rotatably coupled to the stationary heat sink; and an LED light source coupled to the second heat sink; and a fastening device, wherein the stationary heat sink comprises a first aperture extending from an exterior of the stationary heat sink to the opening, and wherein the second heat sink comprises a second aperture formed therein, at least a portion of the fastening device being inserted through the first aperture and into the second aperture to rotatably couple the LED module to the stationary heat sink, the LED module being adjustably positionable by moving the LED module and rotating the second aperture about the fastening device, wherein at least a portion of the second heat sink remains in contact with the stationary heat sink along the full range of rotation of the LED module.

2. The luminaire of claim 1, wherein the LED module is directionally adjustable at an angle ranging from about −3 degrees to about 38 degrees.

3. The luminaire of claim 1, wherein the second heat sink further comprises:

a base portion; and a sidewall extending outwardly substantially around the perimeter of the base portion, the sidewall surrounding a cavity formed therein, wherein the LED light source is thermally coupled along the base portion within the cavity.

4. The luminaire of claim 3, wherein the LED module further comprises a reflector inserted within the cavity and disposed around the LED light source.

5. The luminaire of claim 4, wherein the LED module further comprises a lens coupled to a distal end of the reflector.

6. The luminaire of claim 1, further comprising a spring element, wherein the fastening device comprises a head portion and a rod portion extending outwardly from the head portion, the rod portion being inserted through the spring element, and wherein the spring element is positioned between the head portion and the second aperture, the spring element exerting a force to facilitate and maintain continuous contact between a portion of the second heat sink and a portion of the stationary heat sink along the full range of rotation of the LED module.

7. The luminaire of claim 1, wherein the LED light source generates heat, wherein at least a portion of the heat is removed along a heat removal pathway, the heat removal pathway travelling from the LED light source, to the second heat sink, and to the stationary heat sink.

8. A luminaire, comprising:

a stationary heat sink comprising a top end, a bottom end, and a sidewall extending from the top end to the bottom end, the sidewall surrounding an opening that extends from the bottom end towards the top end;

a rotatably adjustable LED module comprising:

one or more LED light sources; and a second heat sink thermally coupled to the one or more LED light sources and rotatably coupled to the stationary heat sink, at least a portion of the second heat sink being inserted within the opening; and a fastening device rotatably coupling the LED module to the stationary heat sink, wherein the stationary heat sink comprises a first aperture extending from an exterior of the stationary heat sink to the opening, and wherein the second heat sink comprises a second aperture formed therein, at least a portion of the fastening device being inserted through the first aperture and into the second aperture to rotatably couple the LED module to the stationary heat sink, the LED module being adjustably positionable by moving the LED module and rotating the second aperture about the fastening device, and wherein the fastening device facilitates and provides a thermal pathway between the LED module and the stationary heat sink along the full range of rotation of the LED module.

9. The luminaire of claim 8, wherein the LED module is directionally adjustable at an angle ranging from about −3 degrees to about 38 degrees.

10. The luminaire of claim 8, wherein the second heat sink further comprises:

a base portion; and a sidewall extending outwardly substantially around the perimeter of the base portion, the sidewall surrounding a cavity formed therein, wherein the LED light source is thermally coupled along the base portion within the cavity.

11. The luminaire of claim 10, wherein the LED module further comprises a reflector inserted within the cavity and disposed around the LED light source.

12. The luminaire of claim 11, wherein the LED module further comprises a lens coupled to a distal end of the reflector.

13. The luminaire of claim 8, further comprising a spring element, wherein the fastening device comprises a head portion and a rod portion extending outwardly from the head portion, the rod portion being inserted through the spring element, and wherein the spring element is positioned between the head portion and the second aperture, the spring element exerting a force to facilitate and maintain continuous contact between a portion of the second heat sink and a portion of the stationary heat sink along the full range of rotation of the LED module.

14. The luminaire of claim 8, further comprising a substrate, the one or more LED light sources mounted onto the substrate, the substrate being coupled to the second heat sink.

15. A method for assembling a luminaire, comprising;

providing a stationary heat sink comprising a sidewall surrounding an opening formed therein;

inserting at least a portion of an LED module into the opening, the LED module comprising:

at least one LED light source; and a second heat sink thermally coupled to the at least one LED light source; and rotatably coupling the LED module to the stationary heat sink using a fastening device, wherein the stationary heat sink comprises a first aperture extending through the sidewall, and wherein the second heat sink comprises a second aperture formed therein, at least a portion of the fastening device being inserted through the first aperture and into the second aperture to rotatably couple the LED module to the stationary heat sink, the LED module being adjustably positionable by moving the LED module and rotating the second aperture about the fastening device, and wherein the fastening device facilitates and provides a thermal pathway between the LED module and the stationary heat sink along the full range of rotation of the LED module.

16. The method of claim 15, wherein adjustably coupling the LED module to the stationary heat sink further comprises inserting a portion of the fastening device through a spring element prior to inserting a portion of a fastening device into the second aperture, the spring element being positioned between a head portion of the fastening device and the second aperture.

17. The method of claim 16, wherein at least a portion of the second heat sink remains in contact with the stationary heat sink along the full range of rotation of the LED module.

18. A luminaire, comprising:

a stationary heat sink comprising a top end, a bottom end, and a sidewall extending from the top end to the bottom end, the sidewall surrounding an opening that extends from the bottom end towards the top end;

a rotatably adjustable LED module comprising:

one or more LED light sources; and a second heat sink thermally coupled to the one or more LED light sources and rotatably coupled to the stationary heat sink, at least a portion of the second heat sink being inserted within the opening;

a fastening device rotatably coupling the LED module to the stationary heat sink; and a spring element, wherein the fastening device comprises a head portion and a rod portion extending outwardly from the head portion, and through at least a portion of an aperture in the second heat sink, the rod portion being inserted through the spring element, wherein the spring element is positioned between the head portion and the second aperture, the spring element exerting a force to facilitate and maintain continuous contact between a portion of the second heat sink and a portion of the stationary heat sink along the full range of rotation of the LED module, and wherein the fastening device facilitates and provides a thermal pathway between the LED module and the stationary heat sink along the full range of rotation of the LED module.

19. The luminaire of claim 18, wherein the LED module is directionally adjustable at an angle ranging from about −3 degrees to about 38 degrees.

20. The luminaire of claim 18, further comprising a substrate, the one or more LED light sources mounted onto the substrate, the substrate being coupled to the second heat sink.

* * * * *